US005983421A

United States Patent [19]

Walser

[11] Patent Number: 5,983,421

[45] Date of Patent: Nov. 16, 1999

[54] SEATING ASSIST DEVICE

[76] Inventor: Ken Walser, 141 Redwood, Hereford, Tex. 79045

[21] Appl. No.: 09/054,394

[22] Filed: Apr. 3, 1998

[51] Int. Cl.[6] ..... A61G 7/08; A47C 31/00; A45B 3/00

[52] U.S. Cl. ..... 5/81.1 R; 5/658; 5/662; 135/66

[58] Field of Search ..... 5/81.1 R, 652, 5/658, 503.1; 297/DIG. 10; 135/66; 248/127, 231.41

[56] References Cited

U.S. PATENT DOCUMENTS

| | | | |
|---|---|---|---|
| 5,054,137 | 10/1991 | Christensen . | |
| 5,226,439 | 7/1993 | O'Keeffe et al. . | |
| 5,305,773 | 4/1994 | Browning | 135/67 |
| 5,354,022 | 10/1994 | Coonrod . | |
| 5,397,169 | 3/1995 | Willans . | |
| 5,507,044 | 4/1996 | Williamson et al. . | |
| 5,509,152 | 4/1996 | Kippes . | |
| 5,509,432 | 4/1996 | Peterson . | |
| 5,524,303 | 6/1996 | Palmer, Jr. et al. . | |
| 5,560,053 | 10/1996 | Mills . | |
| 5,662,131 | 9/1997 | Scarborough et al. . | |

FOREIGN PATENT DOCUMENTS

| | | | |
|---|---|---|---|
| 000995235 | 6/1965 | United Kingdom | 5/81.1 R |

*Primary Examiner*—Terry Lee Melius
*Assistant Examiner*—James M. Hewitt
*Attorney, Agent, or Firm*—Dowell & Dowell, PC

[57] ABSTRACT

A device for assisting individuals when sitting or standing relative to an article of furniture wherein the device includes a lightweight frame having a pair of handgrasp rails connected to a base having a first portion which is adapted to extend forwardly of an article of furniture and a second portion which is adapted to extend beneath the article of furniture. The device is stabilized by members which abut the front of a chair as the individual's weight shifts to or from the device as the individual stands or sits.

11 Claims, 3 Drawing Sheets

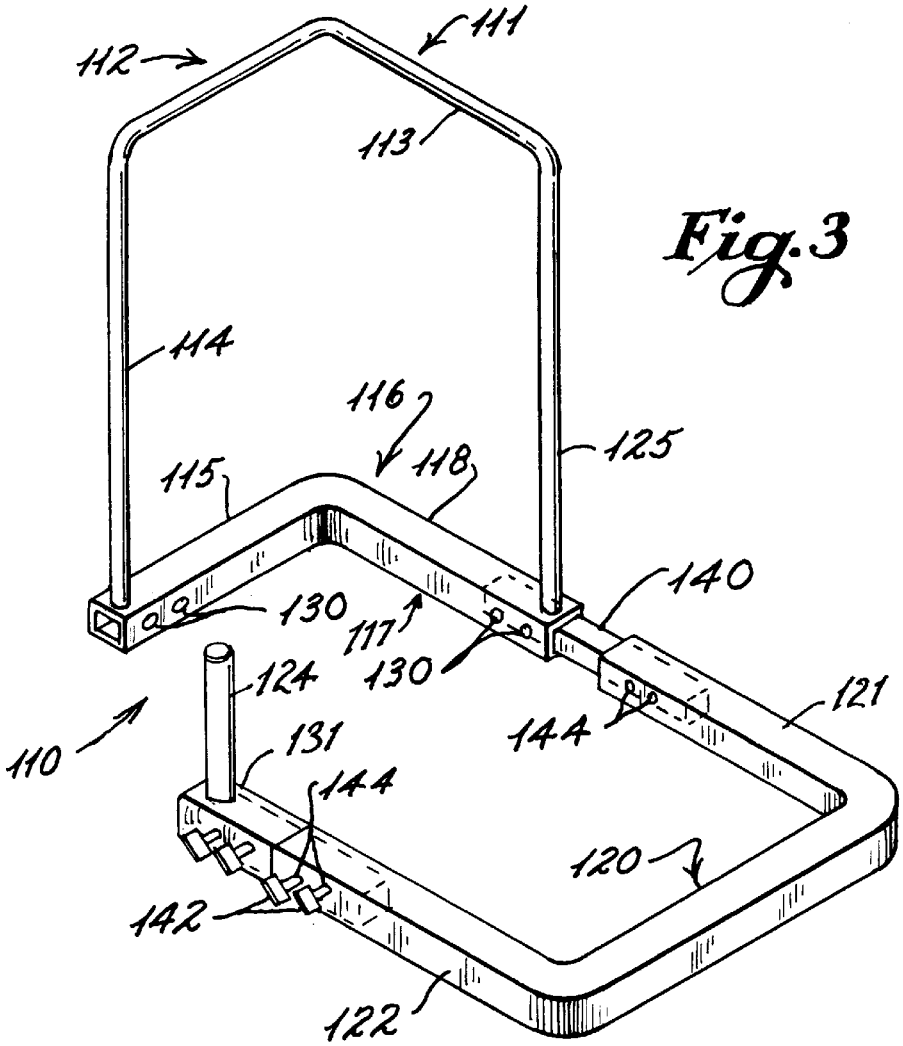
Fig. 3
Fig. 4
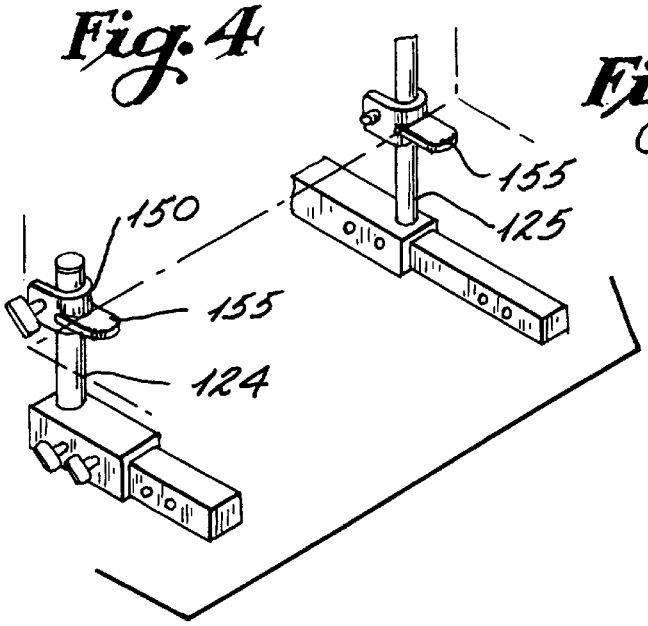
Fig. 5
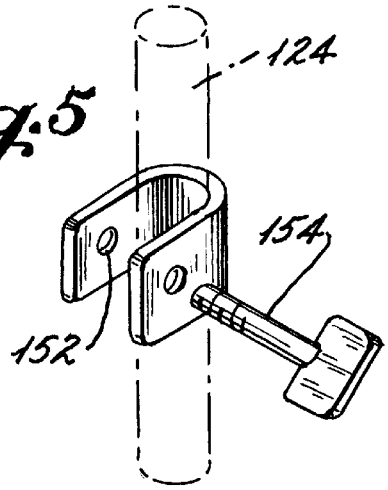

SEATING ASSIST DEVICE

CROSS REFERENCES TO RELATED APPLICATIONS

None

STATEMENT AS TO RIGHTS TO INVENTIONS MADE UNDER

FEDERALLY SPONSORED RESEARCH AND DEVELOPMENT

None

BACKGROUND OF THE INVENTION

The present invention is generally directed to devices for assisting individuals in standing from a seated position or in lowering themselves to a seated position relative to a chair, couch, sofa, bed or other article of furniture. More specifically, the present invention is directed to a lightweight assist device which includes a base having a front first portion which extends forwardly of the article of furniture when in use and a rear second portion which is adapted to be positioned beneath the article of furniture during use. A pair of vertical brace members extend from the base and are adapted to abut the front of the article of furniture when the front portion of the base is positioned beneath the article of furniture to thereby stabilize the device as an individual's weight is shifted to and from the device during use. A pair of handle members extend from the vertical brace members and are oriented in a L-shaped configuration above the front portion of the base for purposes of being grasped by the individual when sitting or standing.

There are many individuals who, because of their age, health, injury or temporary or permanent physical condition, require assistance when sitting or standing relative to a chair, couch, bed or similar article of furniture. Often, such individuals do not have sufficient lower body strength to elevate themselves by pushing on the conventional arms of a chair and, in other instances, other articles of furniture such as a bed or sofa may not have arms positioned to assist the individual when sitting or standing.

In view of the foregoing, there have been a number of innovations developed to help individuals who require the use of their upper body to supplement lower body strength when sitting or standing. Prior to these innovations, individuals would use walking aids to help them when sitting or standing. For instance, an individual using a fixed frame walker would place the walker in front of them when in a seated position and pull themselves upwardly by placing their hands on the handrails of the walker. Unfortunately, because of the positioning of the individual relative to the walker, the walker would tend to tip as the weight distribution is spaced from the legs of the walker a sufficient distance to make the walker unsteady when a person is rising from a sitting position or being lowered from a standing position. This instability makes it difficult and sometimes impractical to use a walker to aid an individual in sitting or standing and, in some instances, can cause injury if the walker were to tip and the individual lose control of their movement.

To overcome the limitations associated with walking aids, it has been proposed to use support or assist devices which are specifically designed to be utilized with a chair or similar article of furniture. In U.S. Pat. No. 5,226,439 to O'Keefe et al., a support device is disclosed for use with chairs wherein the device includes a generally continuous bottom platform upon which a chair may be positioned. A pair of U-shaped rails extend vertically upward on either side of the platform so as to provide vertically adjustable handles on opposite sides of the chair. Unfortunately, with this type of device, a chair must be manuevered onto the support device before an individual can utilize the handles associated therewith. In addition, when standing or sitting, the individual cannot adequately distribute their weight forwardly of the chair as the handles only extend along the sides of the chair.

In U.S. Pat. No. 5,560,053, a transfer device for a person using a wheelchair is disclosed which also discloses a platform-type base. The base is designed to be engaged by the forward portion of the wheelchair and a handlebar is provided which extends from the base toward an individual seated in the wheelchair. Unfortunately, the handle is positioned directly in front of the individual when they are rising to stand and thus acts as an obstruction when the individual attempts to shift their weight to their feet.

In U.S. Pat. No. 5,509,432 to Peterson, a device to assist disabled persons is disclosed which includes a platform having a pair of handrails which are adapted to extend forwardly of a chair or other article of furniture with the handrails being spaced generally parallel with the sides of the chair or other article of furniture. The device includes four elongated leg elements for providing stabilization. When a person desires to stand or sit, their weight is placed on the platform and the handrails which are positioned forwardly of the chair are used to assist them in sitting and/or standing. Unfortunately, the handrails are positioned generally parallel to the sides of the chair and thus require that the individual have a significantly strong grasp to hold onto the rails in that they cannot pull on the rails when sitting or standing. Further, the device requires that an individual, when standing, must move forwardly through the device before being able to reach a walker or other assistance device when moving about. Because of this construction, the forward legs utilized to stabilize the device must extend beyond the hand support rails, thus increasing the weight and manueverability of the device. It would be preferred to have a device which could be utilized by individuals sitting in a chair or similar article of furniture where the device can be easily moved to the side of the article of furniture when not in use, but may be easily pulled and placed into position without a great deal of physical effort.

U.S. Pat. No. 5,354,022 to Coonrod dicloses another patient assist device which includes a handle member which is generally U-shaped and designed to allow a patient to pull themselves forwardly as opposed to grasping a pair of parallel rails as was disclosed in the patent to Peterson. In this patent, the handrail is attached to the forward end of a platform which is designed to be positioned beneath the chair or other seating device and a clamp is provided along a vertical member spaced from the handrail for engaging a leg of the chair so that the device is clamped to the chair to provide stability and prevent the device from rocking relative to the chair when in use. Although this device provides the benefit of allowing a person to pull themselves up when in a seated position, the device does not provide adequate stability if the individual places their hands along a portion of the handrail remote from the stabilization clamp. In these instances, the frame would tend to shift relative to the chair, causing an individual possibly to lose their balance when moving from a sitting to a standing or standing to a sitting position. In addition, the structure requires that the clamped element be engaged with a leg of a chair and thus, once in place, cannot easily be moved and will be an obstruction to an individual which may be an inconvenience when the individual desires to be seated without the device being positioned in front of them.

In view of the foregoing, there remains a need to provide a stable, lightweight and easily manuevered assist device which can be utilized to assist individuals when sitting or standing.

SUMMARY OF THE INVENTION

A device for assisting individuals in sitting or standing relative to an article of furniture, such as a chair, sofa, bed or similar article of furniture which includes a generally L-shaped handrail having a first portion which extends generally parallel to one side of the chair or article of furniture and a second portion which extends generally parallel to the front of the article of furniture and spaced therefrom. The handrail is supported at opposite ends from a first portion of a base member which is adapted to extend forwardly of the article of furniture when in use. The base also includes a second portion which is designed to extend beneath the article of furniture when in use. A pair of vertical brace members extend from the base which are adapted to engage the front of the article of furniture when the second portion of the base is positioned beneath the article of furniture.

In one embodiment of the present invention, the second portion of the base is formed as a substantially continuous member designed to be positioned beneath the article of furniture while, in a second embodiment, the second portion of the base includes a pair of generally parallel stabilizing elements which are designed to be positioned on either side of a platform associated with an article of furniture, such as a lounge chair which is mounted on a platform as opposed to being mounted on legs.

In each of the first and second embodiments discussed above, the vertical brace members may be reinforced by a plate extending therebetween.

To provide adjustability of the device of the present invention, the vertical brace members may be adjustably mounted to the second portion of the base so that they may be selectively extended and retracted relative thereto. In these embodiments, the vertical brace members are mounted to telescoping members which are slidingly received within or about the opposite end portions of a tubular frame defining the second base member.

To provide further stability, the present invention may also incorporate wedge locks which are selectively mounted about the lower portion of each of the stabilizing brace members. The locks are slidingly adjustable relative to the brace members such that tabs extending outwardly therefrom may be slidingly engaged or positioned just beneath and about the bottom portion of the article of furniture such that the tabs will engage the bottom of the furniture to prevent any rocking motion when locked into position, but, however, still permit the device to be easily pushed away or slidingly received beneath the article of furniture and thus do not require a permanent attachment to the article of furniture.

In the preferred embodiment, the first and second frame portions as well as the handrail are integrally formed from a continuous piece of tubing having one end forming one of the vertical brace members from which the tubing extends rearwardly in the U-shaped configuration to form the second portion of the base and from which the tubing further extends forwardly in a L-shaped configuration and then vertically upwardly to one end of the L-shaped handle portion and downwardly from the opposite end thereof to an area of the base adjacent the second portion. In this preferred embodiment, the vertical upright from the first base portion to the handgrip portion is designed to be positioned generally intermediate the parallel sections defining the second portion of the base such that the vertical member is positioned generally centrally of the front portion of an article of furniture when in use.

It is the primary object of the present invention to provide a device for assisting individuals when sitting or standing which includes a base having a portion extendable beneath an article of furniture and brace members abuttable against the front of the article of furniture such that the device is completely stabilized when an individual shifts their weight from either a sitting or standing position by engaging a handrail associated with the device.

It is yet another object of the present invention to provide a device for assisting individuals when sitting or standing which is lightweight and can easily be manuevered by an individual when seated so that the device can easily be brought into position to aid the individual when they desire to stand without assistance from another person.

It is also an object of the present invention to provide a device for assisting individuals when sitting or standing which includes base members which are adapted to be interfitted in alternate configurations such that portions of the base may be varied for use in permitting either left or right hand access to an article of furniture.

It is yet a further object of the present invention to provide a device for assisting individuals when sitting or standing which is low cost and yet which provides stability and safety which is not associated with many prior art devices and which may further include stop elements for positively engaging the bottom edge of a chair or other article of furniture when the device is in use to thereby prevent rocking of the device relative to the article of furniture as the individual's weight is shifted from a sitting and/or standing position.

It is also an object of the present invention to provide a lightweight, low-cost device for use by individuals when sitting or standing wherein the device includes handgrasp portions which are designed to permit both a pulling as well as gripping action by an individual by placing two hands on a generally L-shaped handle configuration such that different muscles are utilized in the arms to facilitate upper body assist of the lower body muscles when sitting or standing.

BRIEF DESCRIPTION OF THE DRAWINGS

FIG. 3 is a rear perspective view of a third embodiment of the present invention;

FIG. 4 is a partial perspective view showing the embodiment of FIG. 3 incorporating locking tabs which may be utilized with each of the embodiments of the present invention and showing their adjusted engagement, in dotted line, against the bottom front edge of an article of furniture;

FIG. 5 is an enlarged perspective view showing the locking device of the locking tabs of FIG. 4;

DESCRIPTION OF THE PREFERRED EMBODIMENTS

Figure 1:
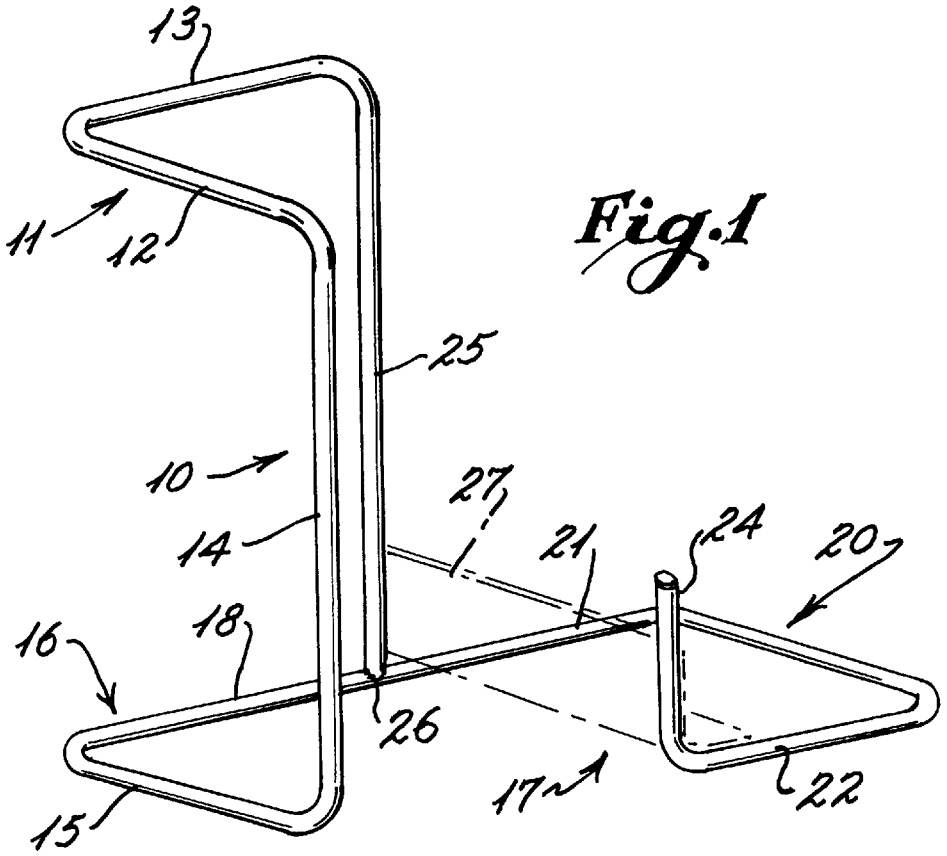
FIG. 1 is a front elevational view of a first preferred embodiment of the present invention.
Figure 6:
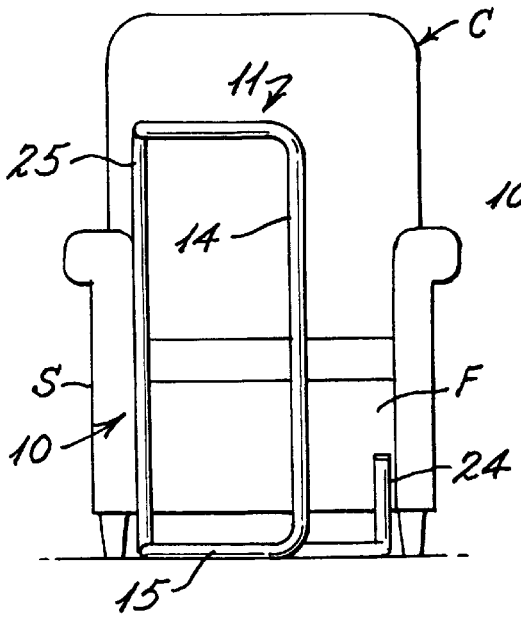
FIG. 6 is a front illustrational view of the invention as shown in FIG. 1 positioned to allow an individual to use the device to be seated.
Figure 7:
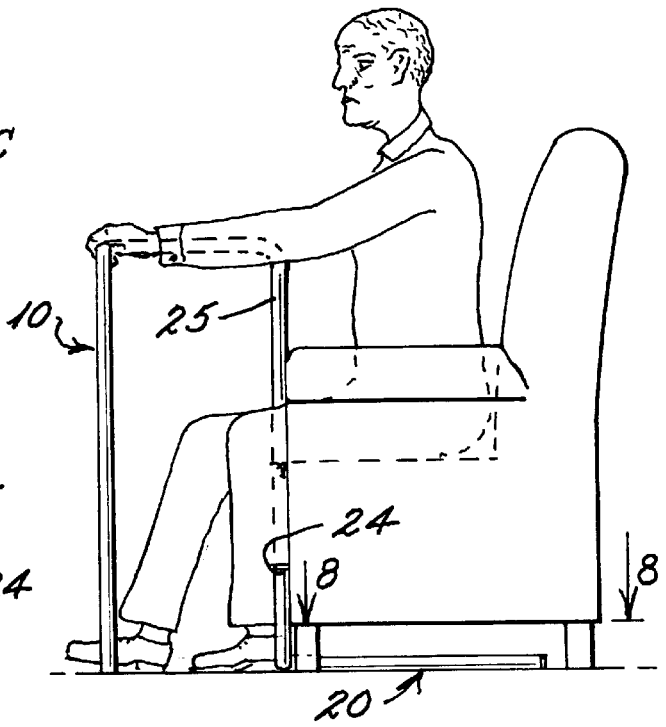
FIG. 7 is a left side view of the embodiment illustrated in FIG. 6 showing an individual utilizing the invention to move from a sitting to a standing position.
Figure 8:
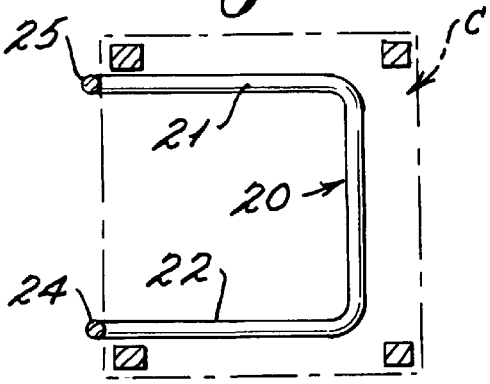
FIG. 8 is a cross-sectional view taken along Line 8—8 of FIG. 7 showing the second portion of the base stabilized beneath the chair of FIG. 7.

With continued reference to the drawing figures, a first and preferred embodiment of the present invention is shown in FIG. 1. The assist device 10 includes a generally L-shaped handle 11 having separate handgrasp portions 12 and 13 which are preferably integrally formed. The outer end of the handgrasp portion 12 is connected and preferably integrally formed with a vertical support 14 which is connected and preferably integrally formed at its lower end to a front member 15 of a first portion 16 of a base 17. The front element 15 is connected at its opposite end to a rearwardly extending floor engaging member 18 which extends rearwardly to a second portion 20 of the base. The second portion of the base is shown as being configured as a generally U-shaped frame having parallel side segments 21 and 22. A vertical brace member 24 extends upwardly from the forward portion of the side member 22 and is adapted to engage the front edge of a chair or other article of furniture "C", as shown in FIGS. 6–8. To further stabilize the assist device of the present invention, the outer end portion of the handgrasp portion 13 of the handrail is connected and preferably integrally formed at its outermost portion to a second vertically extending brace member 25 which terminates such as a weld joint 26 at a point intermediate the side segments 18 and 21 associated with the base member 17. In order to further reinforce the vertical brace members 24 and 25, as shown in dotted line in FIG. 1, a reinforcing plate 27 may be welded or otherwise secured therebetween.

In the embodiment shown in FIG. 1, the entire frame defining the device is formed of an aluminum or steel tubing. Because of this type of construction, the device can be extremely lightweight, thereby making the device easily manueverable by an individual who requires the device when either sitting or standing. Further, as shown by example in FIG. 6, the vertical support 14 extending from the front handgrip portion 12 is shown as being designed to extend generally vertically to a central portion of a chair so that when an individual assumes a standing position or when an individual utilizing the device to achieve a sitting position, they may enter the device through the open area defined between the vertical member 14 and the vertical brace 24 without engaging any obstructions. Further, with the embodiment shown in FIG. 3, the access can be selectively provided either from the right or left by realignment of portions of the frame of the device.

Further, as shown in FIGS. 1 and 6, the front portion of the handrail 12 is shown as extending generally parallel to the front "F" of the chair or other article of furniture when in use. In this position, this portion of the handrail may be grasped by an individual, such as shown in FIG. 7, so that an individual may pull against the front handgrip portion. This structure allows the individual to utilize their upper body strength even though they may not be able to grasp the handrail very securely as the muscles to engage the rail 12 do not require a great deal of strength in the hand. However, the handrail 13 is shown as extending generally parallel to a side "S" of the chair and thus may be grasped an individual who does have sufficient hand strength to facilitate them when sitting or standing. In any embodiment of the present invention, an individual may utilize the front portion 12 of the handrail only when sitting or standing and thus utilize the handrail as a pulling device as opposed to a grasping device.

When the device is in use, as shown in FIGS. 6 and 7, it is noted that the brace members 24 and 25 will abut the front of the chair and that the second portion 20 of the base will extend beneath the chair. In this position, when any force is applied to the front of the chair, the base will tend to prohibit, although not completely limit, rocking motion. To further prevent rocking motion, an individual may place their foot along the front portion 15 of the base, as shown in FIG. 7. However, to further provide for stabilization of the device of the present invention, one or more stop members may be mounted to the vertical brace members as will be discussed with respect to an embodiment shown in FIGS. 3 and 4, although stop members may also be used in each of the embodiments disclosed in the present application.

Figure 2:
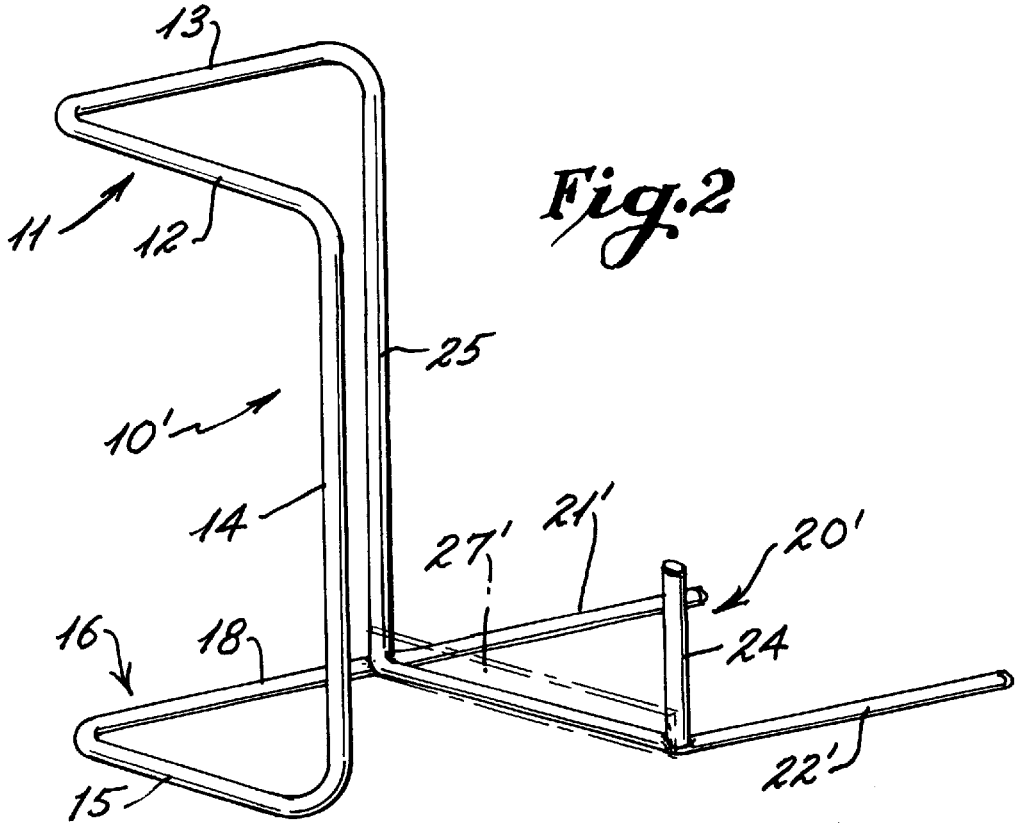
FIG. 2 is a front perspective of a second embodiment of the present invention.
Figure 9:
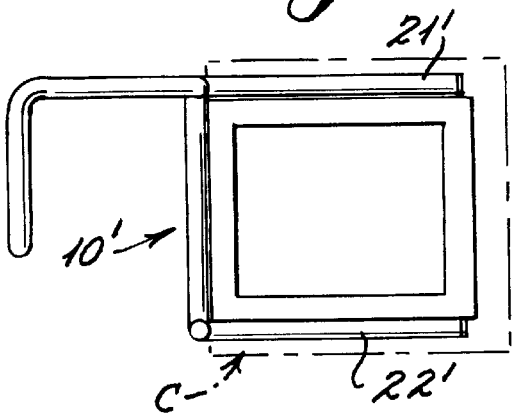
FIG. 9 is a view similar to FIG. 8 showing the second portion of the embodiment of FIG. 2 stabilized on either side of a platform associated with a platform-type lounge chair.

With specific reference to FIG. 2, a modification of the embodiment shown in FIG. 1 is disclosed. In this embodiment, each of the elements which are generally the same as that disclosed in FIG. 1 have a common number. In this embodiment, the second portion 20' of the base includes only a pair of generally parallel stabilizing bars 21' and 22' which are not connected at their outermost ends. With this configuration, the second portion of the assist device 10' may be utilized with a platform-type chair, such as a lounger, which is not supported on spaced legs, but is rather supported on a platform. The positioning of the members 21' and 22' is shown in FIG. 9. In all other respects, the embodiment of FIG. 2 functions and is used in the same manner as the embodiment of FIG. 1. As with the embodiment of FIG. 1, the entire device is very lightweight and can be easily manuevered so as to be moved out of the way of an individual when they are seated and can be easily pulled and positioned in front of the chair when the individual desires to use the device in assisting them to stand.

With particular reference to FIG. 3, a third embodiment of the present invention is shown. In this embodiment, the device 110 includes an ajustable base member. The device includes a generally L-shaped handrail 111 having a front portion 112 and a side handgrasp portion 113. The front handgrasp member 112 is connected to a vertical support 114 which extends to one end of a front frame member 115 associated with a first or outer portion 116 of the base 117. In this embodiment, the first portion 116 of the base 117 is formed as a general hollow tube which may be generally rectangular in cross-section. Each extension of the tube 115 and 118 includes outer end portions having a plurality of spaced openings 130 therein. The handrail 113 is shown as being connected to a vertical brace member 125 which serves the same purpose as the brace member 25 shown in the embodiment of FIGS. 1 and 2. The second portion 120 of the base includes side portions 121 and 122 which are formed of a hollow tubing which may be rectangular in cross-section. As with the embodiment shown in FIG. 1, the second portion of the base is generally U-shaped in outer configuration. In the present embodiment, the front portion 116 of the frame may be moved from a right hand position, shown in FIG. 3, wherein the base segment 118 engages the rear segment 121 to a position wherein the front segment 115 of the base would be engaged in line with section 122 of the rear portion (not shown). In order to accomplish this change in configuration, an adapter block 140 having two sets of aligned openings therein (one set being shown at 142 in FIG. 4) for purposes of aligning with the openings 130 in either of the segments 115 and 118 of the front base portion or with other openings 144 formed in the segments 121 and 122 of the rear base portion. Appropriate set screws or other fasteners may be utilized to secure the components once they are assembled.

The vertical clamp member 124 is made to be interchangeable with respect to either of the segments 121 and 122 of the second portion of the base. As shown, the member 124 is mounted to a tubular sleeve 131 which is designed to slip over or fit within the opening defined in either of the elements 121 and 122. This sleeve also includes a pair of outer openings through which fasteners may be utilized to engage either the openings 144 associated with either of the segments 121 and 122 of the second frame section.

In this embodiment, a person who has a stronger left arm would desire to mount the front portion of the frame such that the handrail portion 113 is parallel to the front of a chair or seat whereas an individual having a stronger right hand grip would probably prefer to have the handrail section 112 mounted generally parallel to the front of the chair. The different handrail positions also define either left or right hand open access between the device and the article of furniture.

To prevent any rocking or tipping motion of any of the embodiments of FIGS. 1–3 relative to an article of furniture when in use, the present invention also contemplates the use of adjustable locking elements 150 which are shown as generally U-shaped sleeves of a size to be fitted about the vertical brace members 124 and 125. Each of the U-shaped members includes aligned openings 152 through which a locking key 154 is adjustably received. Clamping tabs 155 extend outwardly from the U-shaped sleeves 150 so as to be engageable beneath the bottom of the article of furniture, generally as shown in dotted line in FIG. 4. In this position, the tabs 155 prevent any vertical shifting of the base member relative to the chair when the device is in use.

In view of the foregoing, it is noted that the present invention provides a very convenient, lightweight and inexpensive device for allowing individuals to utilize their upper body to assist them in sitting and standing relative to a chair, sofa, couch, bed or other article of furniture. With the invention, the device is stabilized and may be utilized in either a left hand or right hand configuration. The invention further allows for use of the upper body to create a pulling action or a grasping action relative to the handrail of the invention, thus making it easier for an individual to sit and stand while the vertical brace members and the adjustable stop members allow for maximum rigidity of the device when in use.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. An apparatus adapted for use with an article of furniture on which an individual may be seated for assisting the individual to use their upper body strength to help them when standing or sitting wherein the article of furniture includes a front, opposite sides and a bottom supported above a surface, the apparatus comprising:

a base having a first portion adapted to be positioned forwardly of the front of the article of furniture when in use and a second portion adapted to be positioned underlying the bottom of the article of furniture and extending rearwardly from the first portion when in use, said first and second portions of said base being adapted to be engageable in non-rolling contact with a floor to thereby stabilize the apparatus when in use, a pair of vertical brace members extending upwardly from said base and adapted to engage the front of the article of furniture at spaced locations, a vertical support member extending upwardly from said first portion of said base so as to be positioned forwardly of said pair of vertical brace members and in front of the article of furniture when said brace members are engaging the front of the article of furniture, one of said vertical brace members and said vertical support member having upper portions for supporting a generally L-shaped handrail, said handrail including a first handgrip portion which extends from said one of said vertical brace members forwardly of the article of furniture to a second handgrip portion which extends generally parallel to the front of the article of furniture so that said L-shaped handrail does not extend rearwardly of an individual using the apparatus and thus will not interfere with the normal sitting or rising movement of an individual being seated or standing, respectively, and said first portion of said base being generally L-shaped and including a front member having one end portion spaced from said second portion of said base and from which said vertical support member vertically extends and an opposite end portion from which a floor engaging member extends to said second portion of said base, and said one of said vertical brace members extending upwardly from said floor engaging member.

2. The apparatus of claim 1 in which said second portion of said base is generally U-shaped having generally parallel side portions each having an end, and means for selectively securing said floor engaging member of said first portion of said base to one of said ends of said parallel side portions of said second portion of said base.

3. The apparatus of claim 2 including an adapter element selectively receivable between said floor engaging member of said first portion of said base and said one of said ends of said parallel side portions of said second portion of said base.

4. The apparatus of claim 2 including vertically adjustable stop elements mounted on each of said vertical brace members, each of said stop elements including a tab adapted to engage the article of furniture along the bottom thereof.

5. The apparatus of claim 1 including a vertically adjustable stop element mounted on at least one of said pair of vertical brace members, said stop element including a tab adapted to engage the article of furniture along the bottom thereof.

6. The apparatus of claim 5 including a reinforcing member extending between said pair of vertical brace members.

7. The apparatus of claim 1 in which said first and second handgrip portions of said handrail and said first and second portions of said base and said pair of vertical brace members are integrally formed.

8. The apparatus of claim 1 in which said second portion of said base is defined by spaced generally parallel stabilizing members which extend from said pair of vertical brace members.

9. The apparatus of claim 8 including a vertically adjustable stop element mounted on at least one of said pair of vertical brace members, said stop element including a tab adapted to engage the article of furniture along the bottom thereof.

10. The apparatus of claim 9 including a reinforcing member extending between and connecting said pair of vertical brace members.

11. The apparatus of claim 9 in which said first and second handgrip portions of said handrail and said first and second portions of said base and said vertical brace members are integrally formed.

* * * * *